US010759073B2

(12) United States Patent
Gilliver et al.

(10) Patent No.: US 10,759,073 B2
(45) Date of Patent: Sep. 1, 2020

(54) CUTTING MACHINE

(71) Applicant: PRECISION FOAM TECHNOLOGIES PTY LTD, South Windsor (AU)

(72) Inventors: David Gilliver, South Windsor (AU); Brett Lindsay, South Windsor (AU)

(73) Assignee: Precision Foam Technologies PTY LTD (AU)

( * ) Notice: Subject to any disclaimer, the term of this patent is extended or adjusted under 35 U.S.C. 154(b) by 113 days.

(21) Appl. No.: 15/765,989

(22) PCT Filed: Oct. 6, 2016

(86) PCT No.: PCT/AU2016/050939
§ 371 (c)(1),
(2) Date: Apr. 4, 2018

(87) PCT Pub. No.: WO2017/059491
PCT Pub. Date: Apr. 13, 2017

(65) Prior Publication Data

US 2018/0281217 A1 Oct. 4, 2018

(30) Foreign Application Priority Data

Oct. 8, 2015 (AU) ..... 2015904093

(51) Int. Cl.
*B26D 3/28* (2006.01)
*B26D 7/04* (2006.01)
(Continued)

(52) U.S. Cl.
CPC ..... *B26D 3/281* (2013.01); *B26D 1/46* (2013.01); *B26D 3/006* (2013.01); *B26D 7/02* (2013.01); *B26D 7/04* (2013.01)

(58) Field of Classification Search
CPC . B26D 3/281; B26D 1/46; B26D 7/02; B26D 7/025; B26D 7/04; B26D 7/01;
(Continued)

(56) References Cited

U.S. PATENT DOCUMENTS 1,145,654 A * 7/1915 Anderson ..... A61F 13/063 128/894
1,868,932 A * 7/1932 Vernet ..... B26D 3/003 83/861
(Continued)

FOREIGN PATENT DOCUMENTS

GB 874014 * 8/1961
WO 2014138818 A1 9/2014

OTHER PUBLICATIONS

International Search Report, dated Dec. 21, 2016 for Intl App No. PCT/AU2016/050939 (3 pages).

*Primary Examiner* — Evan H MacFarlane
(74) *Attorney, Agent, or Firm* — Rao DeBoer Osterrieder, PLLC; John M. DeBoer

(57) ABSTRACT

A cutting machine for cutting a foam product from a foam blank. The cutting machine has a blank holder adapted to receive the foam blank and a cutting blade. At least one of the blank holder and the cutting blade is mounted for movement relative to the other. The blank holder has a first component having a die projection formed on a front surface of the first component. A second component has a cutting surface and an aperture. A third component has a cutting surface and is locatable in the aperture. At least one of the first component and the second component is mounted for movement relative to the other between a first configuration, in which the first and second components are distal to one another, and a second configuration, in which the first and second components are proximal to one another.

14 Claims, 9 Drawing Sheets

(51) Int. Cl.
*B26D 1/46* (2006.01)
*B26D 7/02* (2006.01)
*B26D 3/00* (2006.01)

(58) Field of Classification Search
CPC . B26D 7/08; B26D 3/28; B26D 3/006; B26D 3/008; Y10T 83/343; Y10T 83/0429; Y10T 83/0433; Y10T 83/0438; Y10T 83/02; B29C 44/5654
USPC ..... 83/176, 19–21, 861
See application file for complete search history.

(56) References Cited

U.S. PATENT DOCUMENTS

| | | | | |
|---|---|---|---|---|
| 2,404,731 | A * | 7/1946 | Johnson | A43B 7/142 12/146 M |
| 3,311,007 | A * | 3/1967 | McGee | B26D 3/281 83/861 |
| 3,665,792 | A * | 5/1972 | Bush | A41H 5/00 83/861 |
| 3,695,128 | A * | 10/1972 | Gentile | B26D 3/281 83/861 |
| 4,351,211 | A | 9/1982 | Azzolini | |
| 6,176,164 | B1 * | 1/2001 | Nylander | B26D 3/281 83/176 |
| 8,844,413 | B2 * | 9/2014 | Koehler | A47G 9/10 83/19 |
| 2011/0167972 | A1 | 7/2011 | Gilliver et al. | |

* cited by examiner

CUTTING MACHINE

RELATED APPLICATIONS

This application is related to Australian Provisional Patent Application No. 2015904093 entitled "Cutting machine" and filed on 8 Oct. 2015 in the name of Precision Foam Technologies Pty Ltd, the entire content of which is incorporated as if fully set forth herein.

STATEMENT REGARDING FEDERALLY SPONSORED RESEARCH OR DEVELOPMENT

Not applicable.

BACKGROUND

Field of the Disclosure

The present disclosure relates to a cutting machine for cutting foam products.

Background of the Disclosure

In the foam product manufacturing industry, foam products are cut to a desired shape in a number of different ways. Complex shapes often require multiple pieces of foam to be individually cut and then bonded together to form the complex shape.

One method of producing integral complex shapes in a consistent manner involves compression cutting, which is used to cut foam products out of foam blocks or sheets. The foam is cut while being compressed between two surfaces, typically between a compression plate and a template or between a roller and a moving template. The foam expands into the template and by cutting the foam adjacent the template, the foam that has expanded into the template can be cut away. This leaves a complimentary pair of foam by-products that generally reflect the shape of the template.

As the foam is compressed between the compression member and the template, the foam expands into recesses in the template and consequently, different portions of the foam product undergo different degrees of compression, depending on the depth of recesses in the template. This creates a varying compression profile in the foam product. Accordingly, as the foam product is cut, the varying compression profile in the foam product creates a cut profile that generally reflects the shape of the template.

The definition of surface details that can be achieved with compression cutting becomes more limited as the density of the foam increases. This is due to the rapidly increasing compressive forces required as foam density increases.

The high levels of compression lead to high levels of abrasive pressure between the cutting blade and the compressed foam material. This can result in abrasion of the foam surface and can create undesirable dust. The high density of foam material presented to the cutting blade results in accelerated wear of the blade and blade supporting structures on a compression cutting machine.

A high level of compression can also cause excessive levels of distortion of the foam material, above that required to generate a particular profile and this can contribute to undesirable variation in the profile of the cut part.

It is also not possible to cut certain complex shapes using compression cutting, due to the compressive forces required to force the foam material into small cavities in the template.

It is also difficult to produce products that require fine detail interior apertures passing through the product.

There is a need in the art to substantially overcome or at least ameliorate one or more of the above disadvantages, or to provide a useful alternative.

SUMMARY

Embodiments of the disclosure pertain to a cutting machine.

In a first aspect, the present invention provides a cutting machine having: a blank holder adapted to receive a foam blank, the blank holder comprising: a first component having a die projection formed on a front surface of the first component; a second component having a cutting surface, an opposite back surface, and an aperture passing from the cutting surface through the second component to the back surface, the aperture corresponding in cross-sectional shape to the external shape of a desired cut foam product; and a third component having an uninterrupted planar cutting surface and an opposite back surface, the third component being releasably securable in a deployed location in the aperture of the second component, wherein the cutting surfaces of the second and third components are coplanar and form a peripheral aperture between the second and third components, the aperture extending around the entire lateral periphery of the third component; and a cutting blade, wherein at least one of the cutting blade and the blank holder is mounted for movement relative to the other; wherein at least one of the first component and the second component is mounted for movement relative to the other and the third component remains located in the aperture of the second component during said movement, wherein said movement ranges between a first configuration, in which the first and second components are distal to one another, and a second configuration, in which the first and second components are proximal to one another, with the front surface of the first component opposing the back surface of the second component, and in which the die projection of the first component is aligned with the aperture of the second component, so as to press foam material of the foam blank through the aperture to protrude beyond the cutting surfaces; wherein the cutting blade is adapted to pass across the cutting surfaces of the second and third components in the second configuration to cut the protruding foam away from the foam blank; and wherein the die projection has raised or flared edges on a leading edge of the die projection with respect to a blade vector of the cutting blade.

In a preferred embodiment, the blank holder is mounted for movement relative to the cutting blade, which remains in a fixed position.

Preferably, the first component is mounted for movement relative to the second and third components.

In a preferred embodiment, the first component is a base plate, the second component is an outer plate and the third component is an inner plate and wherein the base plate is mounted in the blank holder for sliding movement between the first configuration and the second configuration.

Preferably, the inner plate is independently moveable between a retracted position in which the inner plate is spaced away from the outer plate and a deployed position in which the inner plate is located within the aperture of the outer plate.

In a preferred embodiment, the inner plate has a stem extending substantially normal to the back surface and the base plate has a central hole adapted to receive the stem of the inner plate.

Preferably, the blank holder further comprises a locking mechanism adapted to lock the stem of the inner plate to the blank holder and retain the inner plate in the deployed position.

In a preferred embodiment, the cutting machine further comprises an electromagnetic carrier adapted to electromagnetically hold the inner plate, the electromagnetic carrier being movable to move the inner plate between the retracted and deployed positions.

Preferably, the blank holder includes a blank support adapted to receive and locate a foam blank between the first component and the second component in a predetermined alignment with the aperture of the second component.

In a preferred embodiment, the die projection has raised or flared edges on a leading edge of the die projection with respect to the cutting blade.

Preferably, the cutting machine further comprises a compression member adapted to apply a compressive force, normal to the cutting surfaces, to foam material of the foam blank projecting through the peripheral aperture while the cutting blade passes across the cutting surfaces.

These and other embodiments, features and advantages will be apparent in the following detailed description and drawings.

BRIEF DESCRIPTION OF THE DRAWINGS

A full understanding of embodiments disclosed herein is obtained from the detailed description of the disclosure presented herein below, and the accompanying drawings, which are given by way of illustration only and are not intended to be limitative of the present embodiments, and wherein.

DETAILED DESCRIPTION

Figure 1:
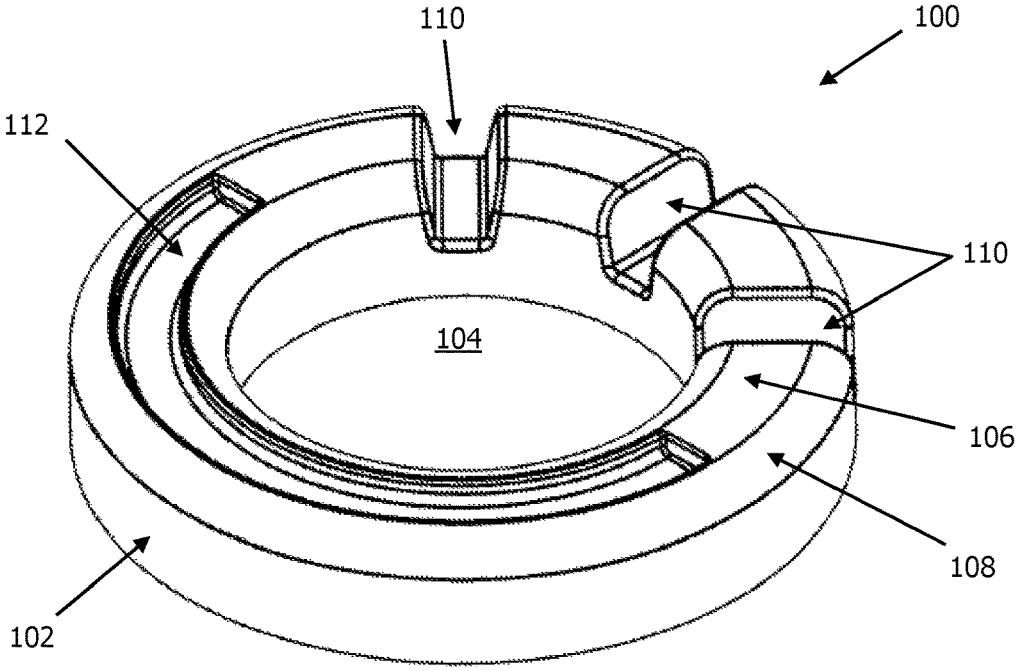
FIG. 1 depicts a cut foam product.

FIG. 1 depicts a complex foam product 100 that can be produced using a particular embodiment of a cutting machine of the present disclosure. The complex foam product 100 has a generally ring-shaped body 102 with a central aperture 104. An upper surface 106 of the foam product 100 has curved edges 108, a series of radial channels 110 and a semi-circumferential groove 112 formed in the upper surface 106.

Figure 2:
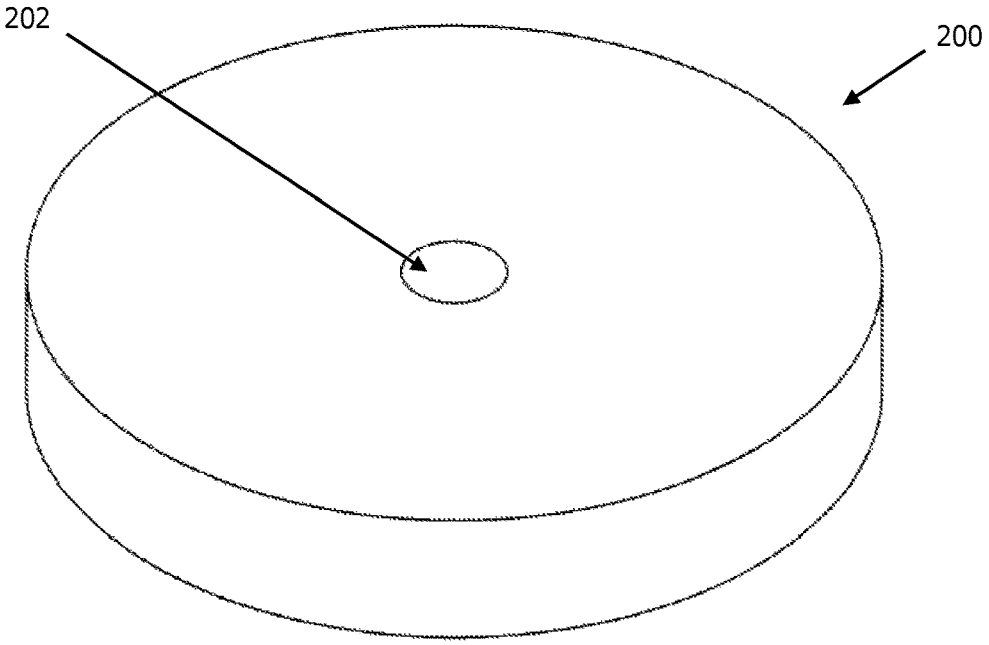
FIG. 2 is a tailored foam blank for producing the cut foam product of FIG. 1.

The first step in producing the complex foam product 100 is to design a tailored blank of foam material 200, as depicted in FIG. 2. For best results, the tailored blank 200 should have an outer shape that reflects a general approximation of the basic outer shape of the foam product 100. For example, the tailored blank 200, shown in FIG. 2, is disc-shaped and has a central hole 202 extending through the tailored blank 200. Forming an appropriately shaped tailored blank 200 minimises foam waste and helps to avoid unintended distortion in the tailored blank during the protrusion phase of the cutting process, which can affect the quality of the cut foam product 100.

Figure 3:
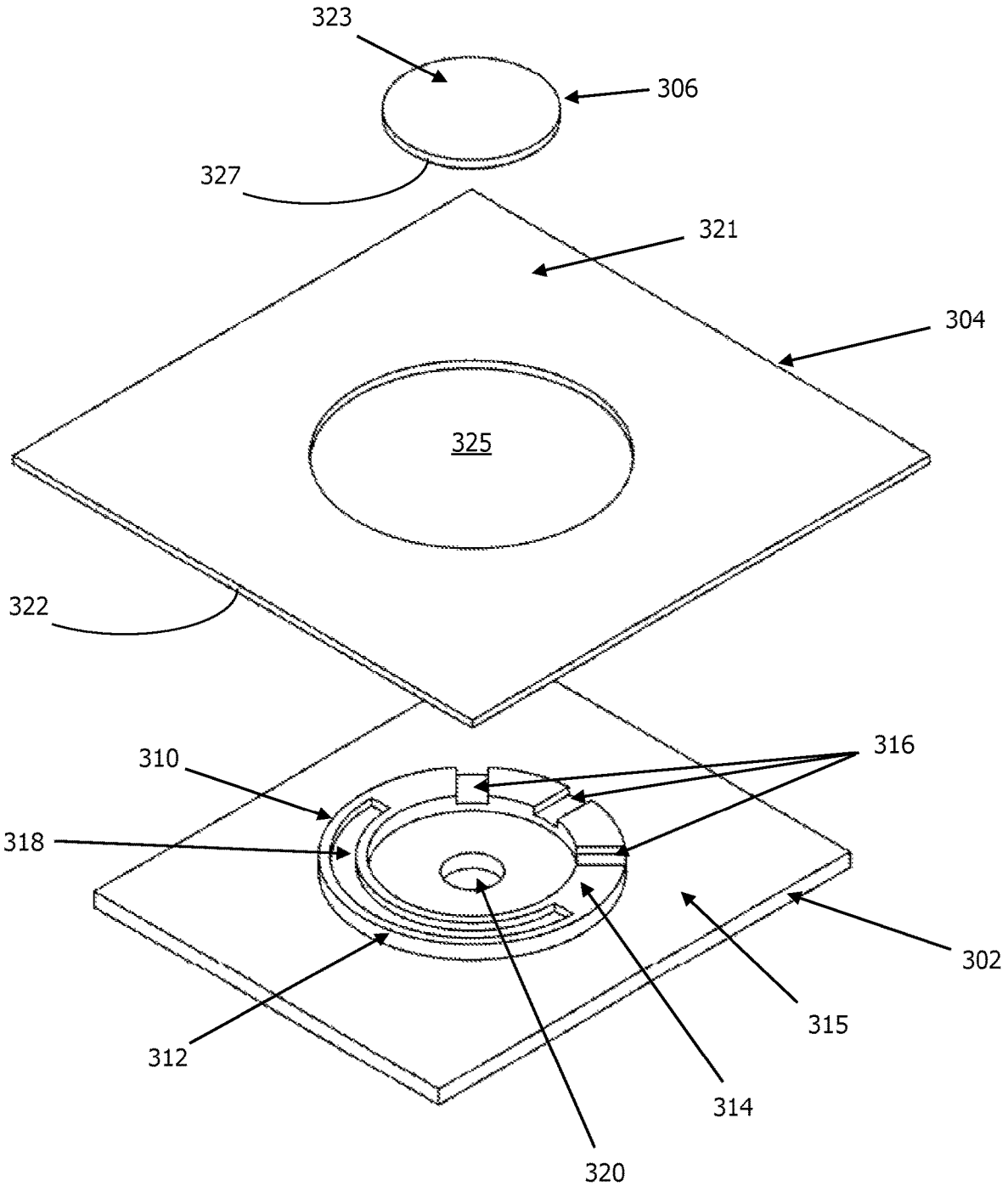
FIG. 3 is an exploded view of isolated components of a cutting machine.
Figure 4:
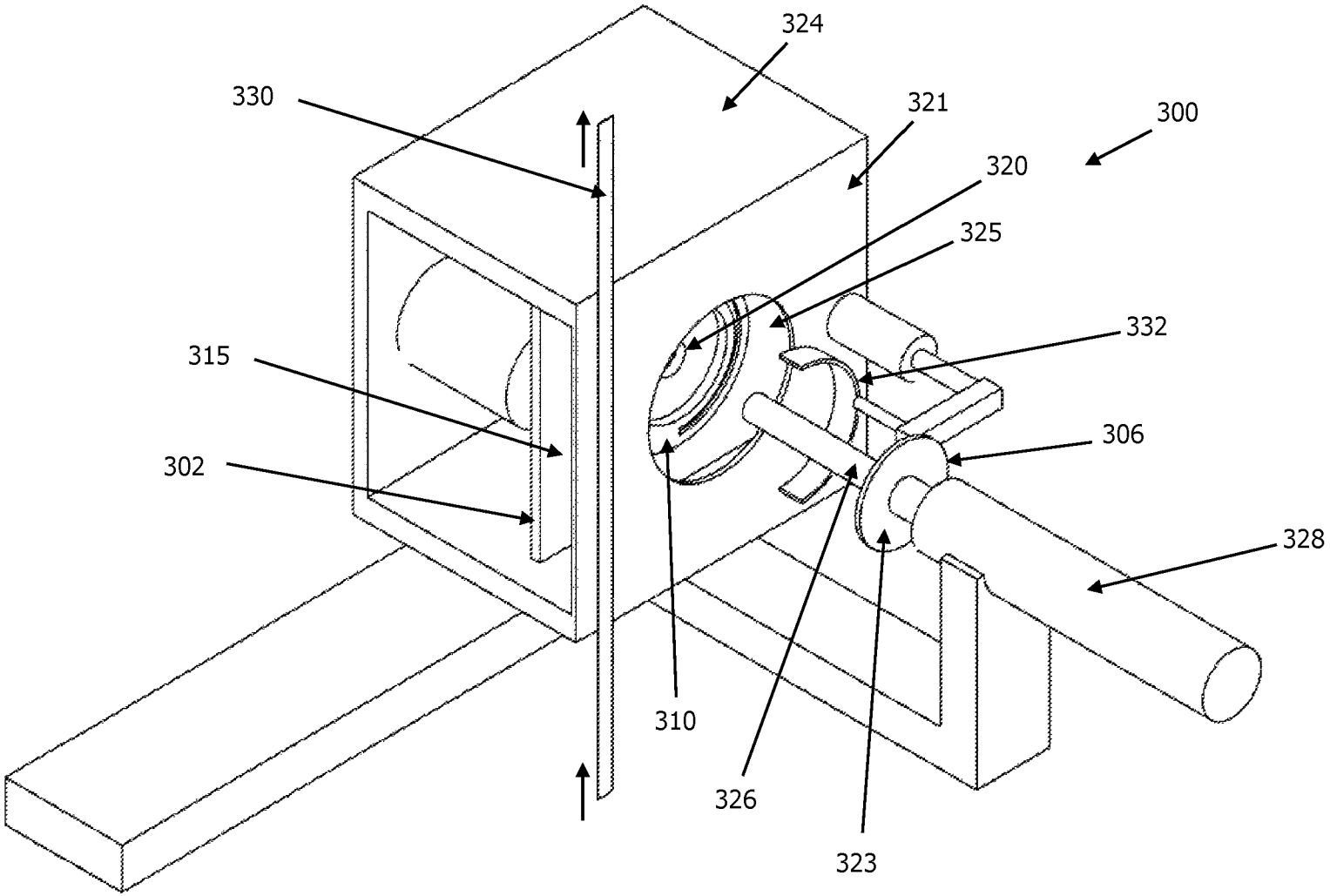
FIG. 4 depicts a cutting machine for cutting the foam product of FIG. 1 from the foam blank of FIG. 2.
Figure 5:
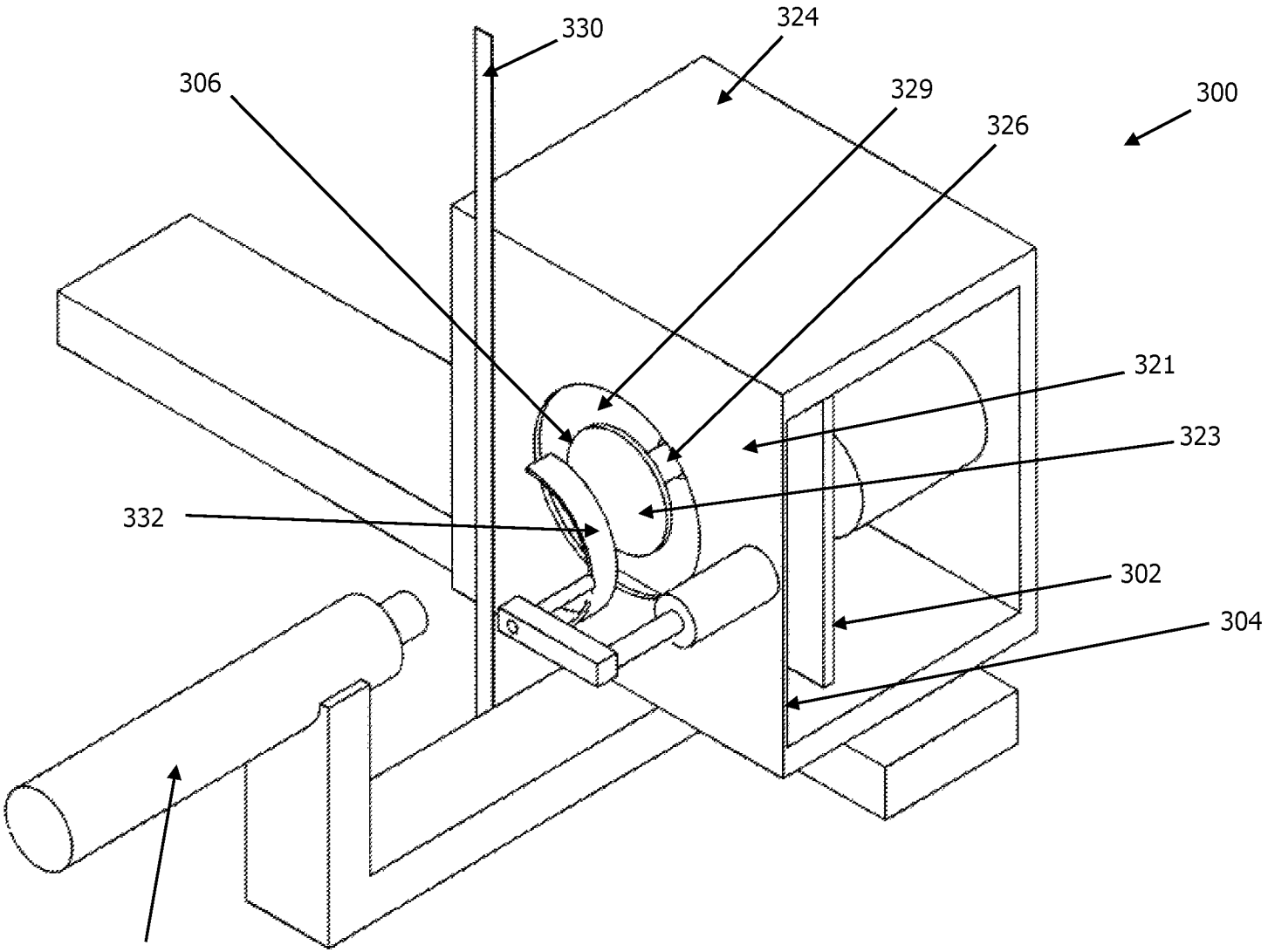
FIG. 5 depicts the cutting machine of FIG. 4 in a further configuration.

The foam product 100 is cut from the tailored blank 200 using the cutting machine 300 depicted in FIGS. 4 and 5. FIG. 3 depicts some of the basic components of the cutting machine 300, which includes a first component, referred to hereinafter as a base plate 302, a second component referred to hereinafter an outer plate 304, and a third component referred to hereinafter as an inner plate 306.

The base plate 302 has a die projection 310 projecting from a front surface 315 of the base plate 302. The die projection 310 has a shape designed to produce the required features of the desired cut foam product 100. In this example, the die projection 310 comprises a ring shaped projection 312 having an upper surface 314 with a series of radial channels 316 and a semi-circumferential groove 318. The base plate 302 also has a central hole 320, passing through the base plate 302.

The outer plate 304 has a front cutting surface 321, an opposing back surface 322 and a circular aperture 325 with a slightly larger diameter than the die projection 310. The aperture 325 determines the external size and shape of the desired cut foam product 100 and can be any shape or size desired.

The inner plate 306 has a front surface 323 and an opposing back surface 327 and has a slightly smaller diameter than the internal diameter of the ring-shaped die projection 310. Likewise, the inner plate 306 can be any shape or size in order to produce apertures in the cut foam product 100 having specific shapes and sizes. Multiple inner plates 306 can also be used to produce multiple apertures in the cut foam product 100.

The cutting machine 300 is depicted in FIG. 4, in a blank loading configuration. The cutting machine 300 has a blank holder 324 incorporating the outer plate 304. The base plate 302 of the cutting machine 300 is mounted for sliding movement relative to the blank holder 324, with the base plate 302 remaining parallel to the outer plate 304 and moving normal to the front surface 315 of the base plate 302 and the front surface 321 of the outer plate 304. The die projection 310 is axially aligned with the circular aperture 325 and the base plate 302 is axially movable between a distal position, in which the base plate 302 is spaced away from the outer plate 304 such that a tailored foam blank 200 can be loaded between the outer plate 304 and the base plate 302, and a proximal position, in which the base plate 302 compresses the tailored foam blank 200 between the base plate 302 and the outer plate 304.

Although not shown in the drawings, a custom shaped bracket is provided on the rear surface of the outer plate 304 within the blank holder 324. The custom bracket is shaped to receive the tailored blank 200 and to hold it in correct alignment with the aperture 325 against the inside surface of the outer plate 304.

The inner plate 306 is attached, or integral with, a stem 326. The inner plate 306 and stem 326 are electromagnetically held by an electromagnetic carrier 328, which is axially movable between a retracted position, shown in FIG. 4 in which the electromagnetic carrier 328, inner plate 306 and stem 326 are spaced away from the blank holder 324, and a deployment position, in which the electromagnetic carrier 328 is adjacent to the plane defined by the front surface 321 of the outer plate 304. In the deployment position, the electromagnetic carrier 328 locates the inner plate 306 in the circular aperture 325, such that the front surface 323 of the inner plate 306 is coplanar with the front surface 321 of the outer plate 304 and the stem 326 passes through the central hole 320 in the base plate 302. This position is depicted in FIG. 5 and forms a peripheral aperture 329 between the inner plate 306 and outer plate 304, which extends around the entire lateral periphery of the inner plate 306. A releasable locking mechanism, such as a bolt or clamp, is provided in the blank holder 324 to engage the stem 326 and lock the stem 326 and inner plate 306 in a deployed position. FIG. 5 shows the inner plate 306 and stem 326 in the deployed position, once the electromagnetic carrier 328 has been demagnetised and returned to the retracted position.

The cutting blade 330 is depicted in FIGS. 4 and 5 and is typically a smooth-edge ground bevel blade. The cutting blade 330 and the blank holder 324 are movable one relative to the other such that the cutting blade 330 passes across the front surfaces 321, 323 of the outer plate 304 and inner plate 306. In one embodiment, the cutting blade 330 is stationary and the blank holder 324 moves relative to the cutting blade 330. In other embodiments, a moving cutting blade 330 and a stationary blank holder 324 may be employed.

A compression member 332 is movable between a retracted position, as shown in FIG. 4 in which the compression member 332 is distal to the blank holder 324, and a deployed position, in which the compression member 332 is proximal to the blank holder 324.

In operation, a tailored foam blank 200 is loaded into the custom shaped bracket on the inside of the outer plate 304 and held in place by the bracket. The electromagnetic carrier 328 then moves from the retracted position to the deployment position and locates the inner plate 306 and stem 326 in the deployed position. The locking mechanism is then used to lock the stem 326 in the blank holder 324 and maintain the inner plate 306 in the deployed position. The electromagnet in the carrier 328 is then switched off, releasing the inner plate 306 from the electromagnetic carrier 328 and the electromagnetic carrier 328 is moved back to the retracted position as shown in FIG. 5.

The base plate 302 is then moved toward the outer plate 304, compressing the tailored blank 200 between the base plate 302 and the outer plate 304 and inner plate 306, causing the foam to protrude through the peripheral aperture 329 between the outer plate 304 and the inner plate 306. This is shown in cross-section in FIG. 6. The compression member 332 is then moved from the retracted position to the deployed position, pressing into the protruding foam. This is shown in cross-section in FIG. 8.

The blank holder 324 is then moved into a cutting alignment position such that the cutting blade 330 is directly adjacent to the front surface 321 of the outer plate 304. The blank holder 324 is then moved across the cutting blade 330 in a transverse direction, such that the cutting blade 330 runs across the front surfaces 321, 323 of both the outer plate 304 and the inner plate 306. In doing so, the cutting blade cuts through the protruding foam along the plane defined by the front surfaces 321, 323 of the outer and inner plates 304, 306, resulting in the cut foam product 100 being cut from the tailored foam blank 200.

Figure 6:
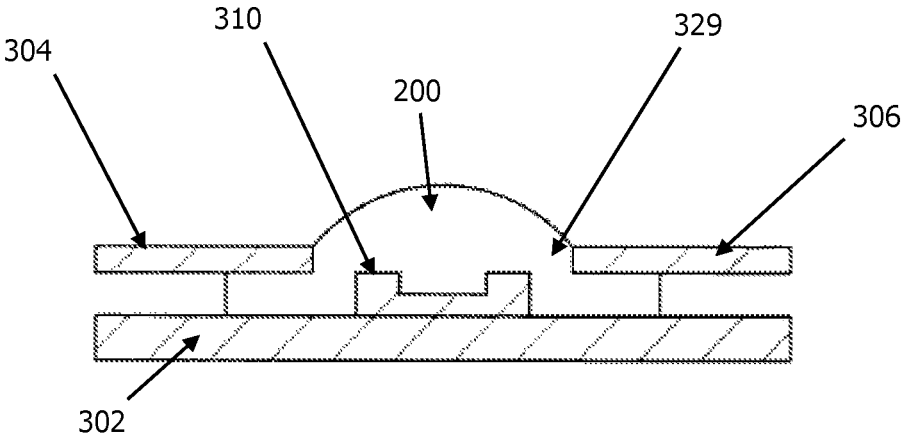
FIG. 6 is a schematic cross-sectional view of a portion of the cutting machine in a first configuration.
Figure 7:
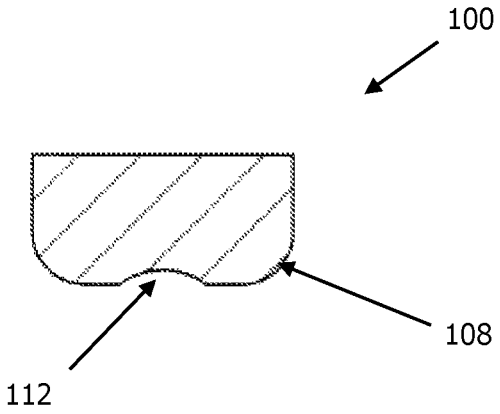
FIG. 7 is a cross-sectional view of a portion of a cut foam product resulting from the configuration shown in FIG. 6.
Figure 8:
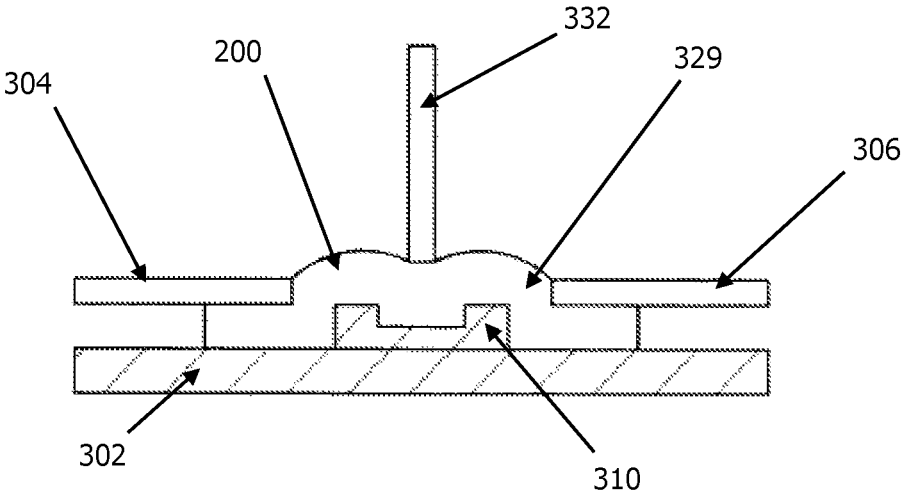
FIG. 8 is a schematic cross-sectional view of a portion of the cutting machine in a second configuration.
Figure 9:
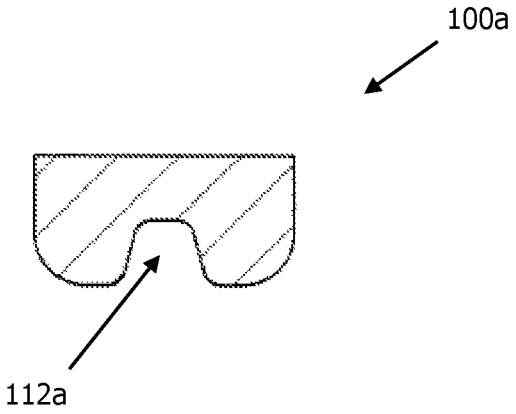
FIG. 9 is a cross-sectional view of a portion of a cut foam product resulting from the configuration shown in FIG. 8.

FIG. 7 and FIG. 9, respectively, depict cross-sections of the foam product 100, 100*a* that result from cutting the same foam blank in the cutting machine 300, without applying the compression member 332, as depicted in FIG. 6, and by applying the compression member 332, as depicted in FIG. 8. As can be seen by comparing the cut foam products 100, 100*a*, and their corresponding grooves 112, 112*a*, applying the compression member 332 results in a deeper, more defined groove 112 than not applying the compression member 332. This is because more of the foam material is pressed into the corresponding groove feature 318 of the die projection 310.

Figure 10:
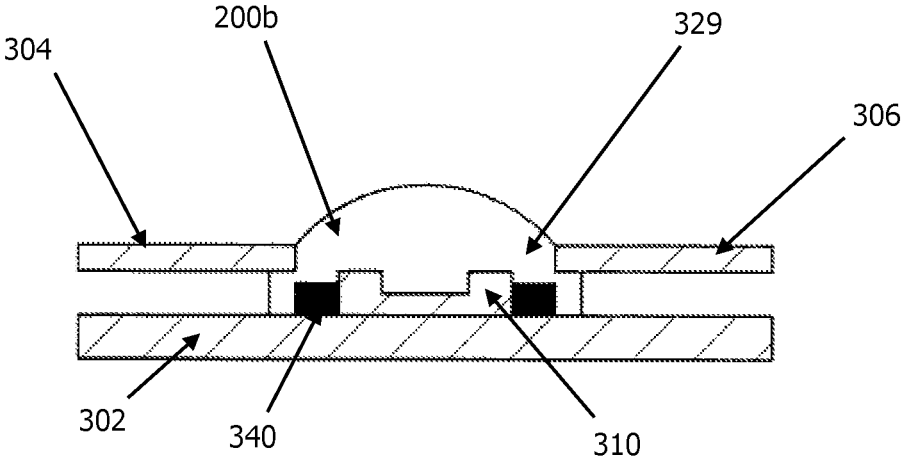
FIG. 10 is a schematic cross-sectional view of a portion of the cutting machine in a third configuration.
Figure 11:
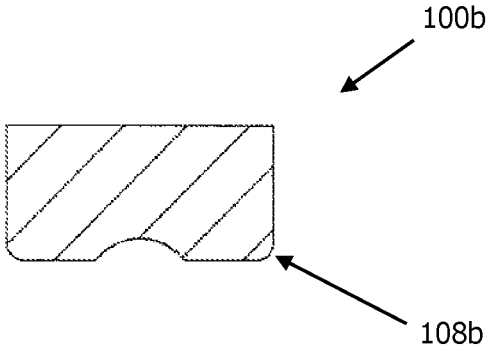
FIG. 11 is a cross-sectional view of a portion of a cut foam product resulting from the configuration shown in FIG. 10.

When the foam blank 200 is compressed between the base plate 302 and the outer plate 304, the foam material between the edges of the die projection 310 and the edges of the aperture 325 experiences a lower compressive force, creating the curved edges 108 of the cut foam product 100. For certain applications, it may be desirable to provide a cut foam product 100 with more or less of a rounded edge profile. FIG. 10 depicts a cutting machine, in which the die projection 310 is provided with a shim portion 340 that extends laterally, so that the edge of the shim portion 340 approximately aligns with the edge of the peripheral aperture 329. This results in more of the foam material at the edges being pressed into and through the peripheral aperture 329, which results in the cut foam product 100*b*, as depicted in cross-section in FIG. 11, having less rounded and more defined edges 108*b*. It also allows the cut foam product 100*b* to be produced from a much smaller tailored blank 200*b*, which provides the benefit of improved material yield. The shim portion 340 may be one or more components added to the die projection 310 or may be integrally formed as part of the die projection 310.

Figure 12:
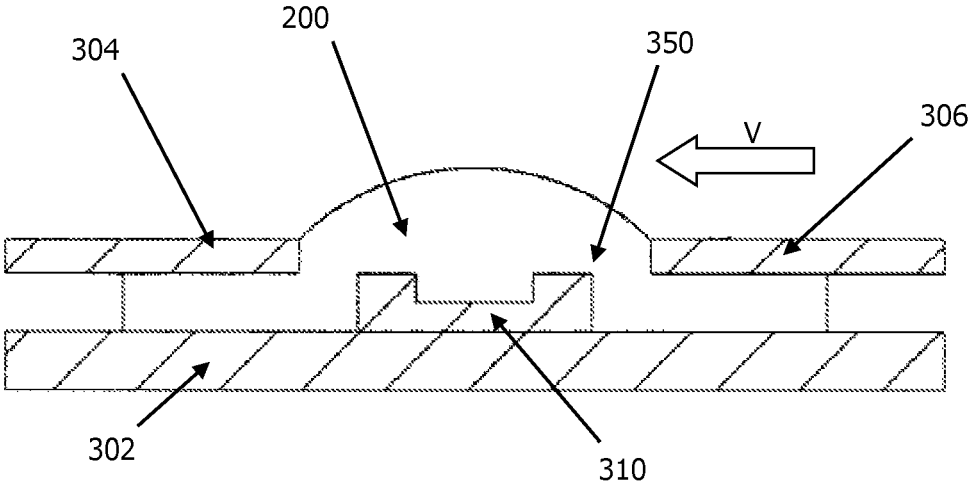
FIG. 12 is a schematic cross-sectional view of a portion of the cutting machine in a fourth configuration.
Figure 13:
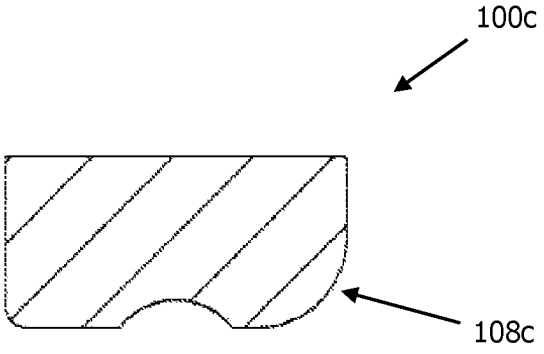
FIG. 13 is a cross-sectional view of a portion of a cut foam product resulting from the configuration shown in FIG. 12.
Figure 14:
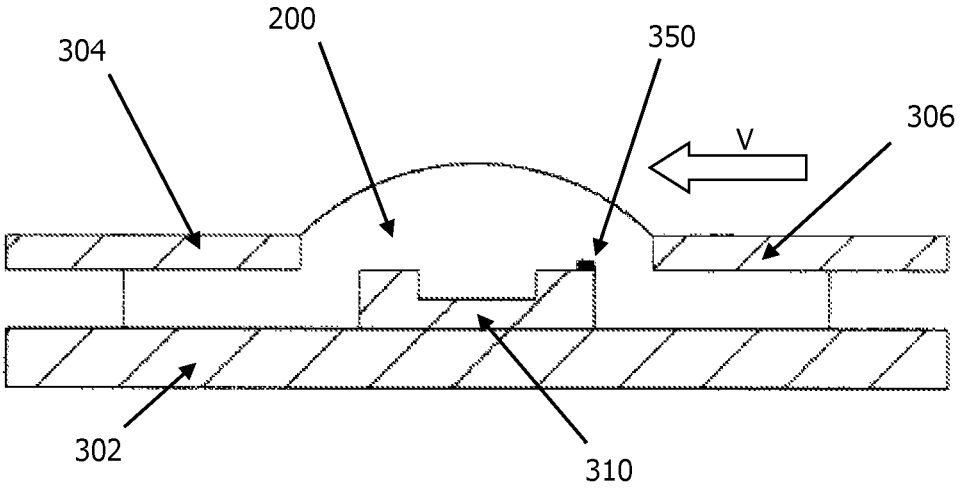
FIG. 14 is a schematic cross-sectional view of a portion of the cutting machine in a fifth configuration.
Figure 15:
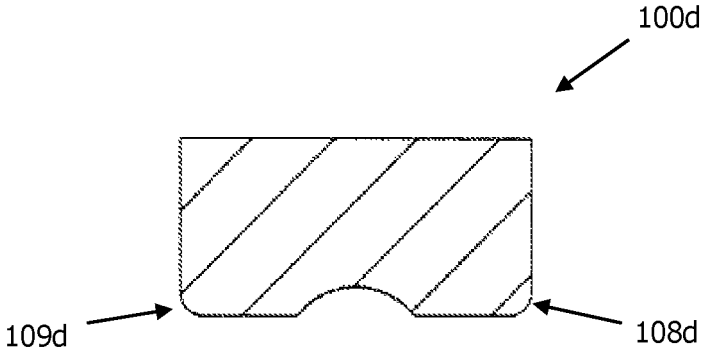
FIG. 15 is a cross-sectional view of a portion of a cut foam product resulting from the configuration shown in FIG. 14.

The cutting blade 330 runs continuously in a longitudinal running direction such as indicated by the arrows in FIG. 4. During cutting of the foam product 100, the running direction of the cutting blade 330 and the relative movement of the tailored blank 200 across the cutting blade 330 (or the blade 330 across the blank 200) creates a blade vector V, being the resultant force, acting on the tailored blank 200. The force of the blade vector V applied by the cutting blade 330 can have a distorting effect on the tailored foam blank 200. The degree of distortion can be a function of the foam material hardness or stiffness. As shown in exaggerated example in FIGS. 12 and 13, this can result in the cut foam product 100*c* having a slightly deformed or irregular shape to the leading edge 108*c* of the cut foam product 100*c*. In order to correct this issue, as shown in FIGS. 14 and 15, the present disclosure provides a cutting machine 300 having a die projection 310 with an asymmetric profile. Relative to the blade vector direction V, the leading edges 350 of the die projection 310 are raised or flared to provide slightly greater protrusion of the foam blank 200 at each leading edge 350. As shown in FIG. 14, the raised or flared leading edges 350 of the die projection 310 result in the same or corresponding surface profile at the leading edge 108*d* as the trailing edge 109*d* of the cut foam product 100*d*. The asymmetric profile balances the effect of the blade vector V and produces a symmetrical and evenly cut foam product 100*d*. Alternatively, or in conjunction, the corresponding trailing edges may be relieved relative to the blade vector V to provide the same effect. The application of such an asymmetric die projection allows faster cutting strokes thereby improving cutting cycle times and improving the economics of the cutting process.

As the cutting blade 330 approaches the end of the cutting process, only a small amount of foam material joins the cut foam product 100 to the foam blank 200. In this situation, the lateral force of the cutting blade 330 can draw extra foam material through the aperture 325 causing the cut foam product to have an undesired variable surface shape and dimension. This can be prevented by having a stop member abutting the protruding foam material, in a direction opposed to the base plate 302 near where the cutting blade exits the foam material.

Although the invention has been described with reference to specific examples, it will be appreciated by those skilled in the art that the invention may be embodied in many other forms.

What is claimed is:

1. A cutting machine comprising:

a blank holder adapted to receive a foam blank, the blank holder comprising:

a first component having a die projection formed on a front surface of the first component;

a second component having a cutting surface, an opposite back surface, and an aperture passing from the cutting surface through the second component to the back surface; and a third component having an uninterrupted planar cutting surface and a third component opposite back surface, the third component being releasably securable in a deployed location in the aperture of the second component, so that the cutting surfaces of the second and third components are coplanar and form a peripheral aperture between the second and third components; and a cutting blade; and an electromagnetic carrier configured to move and electromagnetically hold the third component;

wherein at least one of the first component and the second component is mounted for movement relative to the other of the first component and the second component, respectfully, while the third component remains located in the aperture of the second component, wherein the cutting machine comprises a cutting configuration, in which the first and second components are proximal to one another, with the front surface of the first component opposing the back surface of the second component, and in which the die projection of the first component is aligned with the aperture of the second component;

wherein the cutting blade is adapted to pass across the cutting surfaces of the second and third components in the cutting configuration to cut a protruding portion of foam away from the foam blank;

wherein the third component is configured to fit within the aperture of the second component;

and wherein the die projection has raised or flared edges on a leading edge of the die projection with respect to a blade vector of the cutting blade.

2. The cutting machine of claim 1, wherein the die projection has relieved or tapered edges on a trailing edge of the die projection with respect to the blade vector of the cutting blade.

3. The cutting machine of claim 1, wherein the first component is mounted for movement relative to the second and third components.

4. The cutting machine of claim 3, wherein the first component is a base plate, the second component is an outer plate and the third component is an inner plate and wherein the base plate is mounted in the blank holder for sliding movement.

5. The cutting machine of claim 4, wherein the inner plate is independently moveable between a retracted position in which the inner plate is spaced away from the outer plate and a deployed position in which the inner plate is located within the aperture of the outer plate.

6. The cutting machine of claim 5, wherein the inner plate has a stem extending substantially normal to the third component opposite back surface and the base plate has a central hole adapted to receive the stem of the inner plate.

7. The cutting machine of claim 1, further comprising a compression member adapted to apply a compressive force, normal to the cutting surfaces, to foam material of the foam blank projecting through the peripheral aperture while the cutting blade passes across the cutting surfaces.

8. The cutting machine of claim 1, wherein the electromagnetic carrier is configured to releasably deploy the third component in the deployed location, the carrier being retractable to allow the cutting blade to pass across the entire cutting surface of the third component.

9. A cutting machine comprising:

a blank holder adapted to receive a foam blank, the blank holder comprising:

a base plate further comprising a front surface and a die projection formed on the front surface;

an outer plate further comprising: a cutting surface, an opposite back surface, and an aperture passing from the cutting surface through the outer plate to the back surface, the aperture configured in cross-sectional shape to accommodate a shape of a desired cut foam product; and an inner plate further comprising: a planar cutting surface and an opposite inner plate back surface, the inner plate being releasably securable in a deployed position in the aperture, whereby the cutting surface of the outer plate and the planar cutting surface are coplanar and form a peripheral aperture between the outer plate and the inner plate; and a cutting blade; and an electromagnetic carrier configured to electromagnetically move and hold the inner plate;

wherein in a first configuration of the cutting machine the base plate and the outer plate are distal to one another, and in a second configuration of the cutting machine the base plate and the outer plate are proximal to one another, with the front surface opposing the opposite back surface of the outer plate, and in which the die projection is configured to align with the aperture of the outer plate so as to cause at least a portion of material of the foam blank to protrude through the aperture of the outer plate;

wherein the cutting blade is configured to pass across the cutting surface of the outer plate and the planar cutting surface in the second configuration to cut the at least the portion of material away from the foam blank;

and wherein the die projection has raised or flared edges on a leading edge of the die projection with respect to a blade vector of the cutting blade.

10. The cutting machine of claim 9, wherein the inner plate further comprises a stem extending normal to the opposite inner plate back surface, and wherein the base plate has a central hole adapted to receive the stem.

11. The cutting machine of claim 10, the cutting machine further comprising a compression member configured to be moved to press into the at least the portion of material, wherein the die protection is ring-shaped.

12. The cutting machine of claim 11, wherein the blank holder is configured to retain the stem and the inner plate in the second configuration after the electromagnetic carrier is disconnected.

13. The cutting machine of claim 11, wherein the blank holder is configured to receive and locate the foam blank between the base plate and the outer plate in a predetermined alignment with the aperture of the outer plate.

14. The cutting machine of claim 13, wherein the compression member is operable to apply a compressive force, normal to each of the cutting surface of the outer plate and the planar cutting surface.

* * * * *